US010398284B2

(12) United States Patent
Hansen

(10) Patent No.: US 10,398,284 B2
(45) Date of Patent: Sep. 3, 2019

(54) DISHWASHER GUIDE RAIL ASSEMBLY

(71) Applicant: WHIRLPOOL CORPORATION, Benton Harbor, MI (US)

(72) Inventor: Matthew Martin Kenneth Hansen, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 82 days.

(21) Appl. No.: 15/403,215

(22) Filed: Jan. 11, 2017

(65) Prior Publication Data

US 2018/0192852 A1 Jul. 12, 2018

(51) Int. Cl.
*A47L 15/50* (2006.01)

(52) U.S. Cl.
CPC ..... *A47L 15/507* (2013.01)

(58) Field of Classification Search
CPC ..... A47L 15/507
See application file for complete search history.

(56) References Cited

U.S. PATENT DOCUMENTS

| | | | | |
|---|---|---|---|---|
| 3,469,892 | A | 9/1969 | Langstroth | |
| 4,006,945 | A | 2/1977 | Sekerich | |
| 5,302,030 | A | 4/1994 | Buie et al. | |
| 7,350,270 | B2 | 4/2008 | Fournier | |
| 8,708,434 | B2 | 4/2014 | Oppel | |
| 2005/0133469 | A1* | 6/2005 | Mersch | A47L 15/504 211/41.8 |
| 2010/0206670 | A1 | 8/2010 | Schroeder et al. | |

FOREIGN PATENT DOCUMENTS

| | | | |
|---|---|---|---|
| CN | 205094358 | U | 3/2016 |
| CN | 205126159 | U | 4/2016 |
| DE | 102009002671 | A1 | 10/2010 |
| DE | 102013211560 | A1 | 12/2014 |
| DE | 102013226857 | A1 | 6/2015 |

* cited by examiner

*Primary Examiner* — Jason Y Ko
(74) *Attorney, Agent, or Firm* — McGarry Bair PC

(57) ABSTRACT

In one aspect, a dishwasher includes a tub at least partially defining a treating chamber and defining an access opening, a dishrack, and a guide rail assembly slidably mounting the dishrack to the tub. The guide rail assembly has a guide rail mounted to the dishrack or to the tub and has at least one wheel which is rotatably mounted onto an integral axle of the guide rail assembly to the other of the dishrack or the tub.

34 Claims, 7 Drawing Sheets

DISHWASHER GUIDE RAIL ASSEMBLY

BACKGROUND OF THE INVENTION

Contemporary automatic dishwashers for use in a typical household include a tub defining a treating chamber and a spraying system for recirculating liquid throughout the tub to remove soils from dishes and utensils. Upper and lower dishracks for holding dishes to be cleaned are typically provided within the treating chamber and mounted to the tub by extensible support rails, also referred to as slide, guide or glide rails. The dishwasher is generally provided with a door, pivotally mounted to the tub, that provides access to the treating chamber when the door is in the open position and also permits the upper and lower dishracks to extend from the treating chamber to the outside of the tub.

BRIEF DESCRIPTION OF THE INVENTION

In one aspect, a dishwasher includes a tub at least partially defining a treating chamber having an access opening, a dishrack, a guide rail assembly slidably mounting the dishrack to the tub and comprising a guide rail mounted to one of the dishrack and tub and having at least one integral axle with a first raceway and terminating in a deflector. The guide rail assembly further includes at least one wheel having a rim with a face defining an axle opening and a second raceway located in the face, and a set of ball bearings located in the second raceway, wherein the axle opening is sized to receive the axle such that the at least one wheel can be slid onto the axle until the first and second raceways axially align and the ball bearings in the second raceway are deflected by the deflector into the second raceway until the first and second raceways are aligned and the ball bearings extend into both the first and second race ways.

In another aspect, a guide rail assembly includes a tub at least partially defining a treating chamber having an access opening, a dishrack, a guide rail assembly slidably mounting the dishrack to the tub and comprising a guide rail mounted to one of the dishrack and tub and having at least one integral axle with a first raceway and terminating in a deflector. The guide rail assembly further includes at least one wheel having a rim with a face defining an axle opening and a second raceway located in the face, and a set of ball bearings located in the second raceway, wherein the axle opening is sized to receive the axle such that the at least one wheel can be slid onto the axle until the first and second raceways axially align and the ball bearings in the second raceway are deflected by the deflector into the second raceway until the first and second raceways are aligned and the ball bearings extend into both the first and second race ways.

In a further aspect a dishwasher includes a tub at least partially defining a treating chamber having an access opening, a dishrack, a guide rail assembly slidably mounting the dishrack to the tub and comprising a guide rail mounted to one of the dishrack and tub and having at least one integral axle with a first raceway, at least one wheel having a rim with a face defining an axle opening and a second raceway located in the face, and a set of ball bearings located in the second raceway, wherein the axle opening is sized to receive the axle such that the at least one wheel can be slid onto the axle until the first and second raceways axially align and the ball bearings extend into both the first and second race ways.

DESCRIPTION OF EMBODIMENTS OF THE INVENTION

Figure 1:
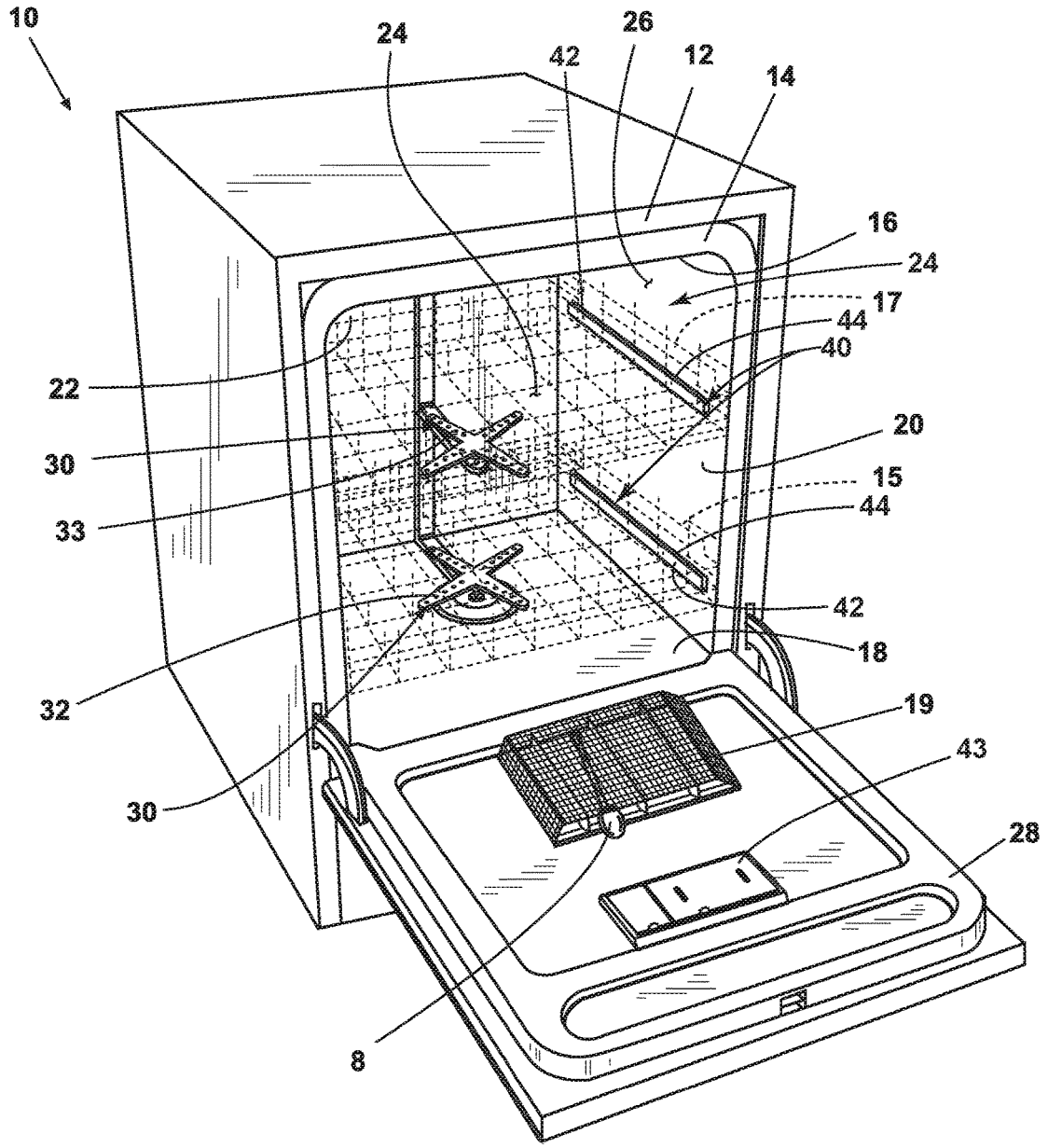
FIG. 1 is a perspective view of a dishwasher with the door open and including a guide rail assembly.

FIG. 1. illustrates an automated dishwasher 10 according to aspects of the disclosure described herein. The dishwasher 10 can treat dishes according to an automatic cycle of operation. Depending on whether the dishwasher 10 is a stand-alone or built-in, a cabinet 12 of the dishwasher 10 may be a chassis/frame with or without panels attached, respectively. The dishwasher 10 shares many features of a conventional automatic dishwasher, which will not be described in detail herein except as necessary for a complete understanding of the invention. While the present invention is described in terms of a conventional dishwashing unit, it could also be implemented in other types of dishwashing units, such as in-sink dishwashers, multi-tub dishwashers, or drawer-type dishwashers.

A tub 14 is disposed within the cabinet 12 and has spaced top and bottom walls 16 and 18, spaced side walls 20, and a rear wall 22. The walls 16, 18, 20, and 22 join along their respective edges to define a treating chamber 24 with an access opening 26. Utensil holders in the form of upper and lower dishracks 15, 17 are located within the treating chamber 24 and receive utensils for washing. The dishracks 15, 17 are typically mounted to side walls 20 for slidable movement in and out of the treating chamber 24 for ease of loading and unloading and can be in the form of a wire-frame. The dishracks 15, 17 can be mounted with a guide rail assembly 40. The guide rail assembly 40 can include at least two guide rails. At least one of the guide rails, the guide rail mount 42, can be snapped to or otherwise mounted to the upper and lower dishracks 15, 17 as illustrated. The guide rail mount 42 can include, but is not limited to, an adjustable rack arm. The other of the guide rails is a guide rail track 44 that is mounted to the tub 14 along the side walls 20. The position of the guide rail mount 42 and the guide rail track 44 can be on one or the other of the upper and lower dishracks 15, 17 or the side walls 20. Any combination of the guide rail mount 42 and guide rail track 44 are contemplated.

Another utensil holder in the form of a silverware basket 19 is located on the door 28. The silverware basket 19 can be removably mounted to the door. Utensil holders 15, 17 and 19 all hold various utensils for washing within the treating chamber. As used in this description, the term utensil is generic to dishes and the like that are washed in the dishwasher 10 and expressly includes, dishes, plates, bowls, silverware, glassware, stemware, pots, pans, and the like A utensil, in the form of a spoon 8, is shown located in the silverware basket 19.

A door 28 is hingedly mounted to the dishwasher 10 and can move between an opened position, as illustrated in FIG. 1, to provide access to the treating chamber 24 and a closed position (not shown) to close the treating chamber 24 by covering the access opening 26 of the treating chamber 24.

Typically, the door 28 is in the opened position when utensils are loaded or unloaded into the dishwasher 10 and in the closed position while the washing cycle is running or while the dishwasher 10 is not in use. A bulk wash aid dispenser 43 is mounted on an inside surface of the door 28 such that the bulk wash aid dispenser 43 is disposed in the treating chamber 24 when the door 28 is in the closed position.

Additionally, the dishwasher 10 comprises a liquid circulation system 30 for introducing and circulating liquid and wash aids, such as detergents, rinse aids, and the like, throughout the treating chamber 24. The liquid circulation system comprises a pump (not shown) located in a lower portion or sump of the tub 14 and which pumps liquid to sprayers 32 and 33. Sprayers 32, 33 are located, respectively, beneath lower rack 15 and upper rack 17 and are illustrated as rotating spray arms. Another sprayer can be located above the upper rack 17 and is illustrated as a fixed spray nozzle.

Figure 2:
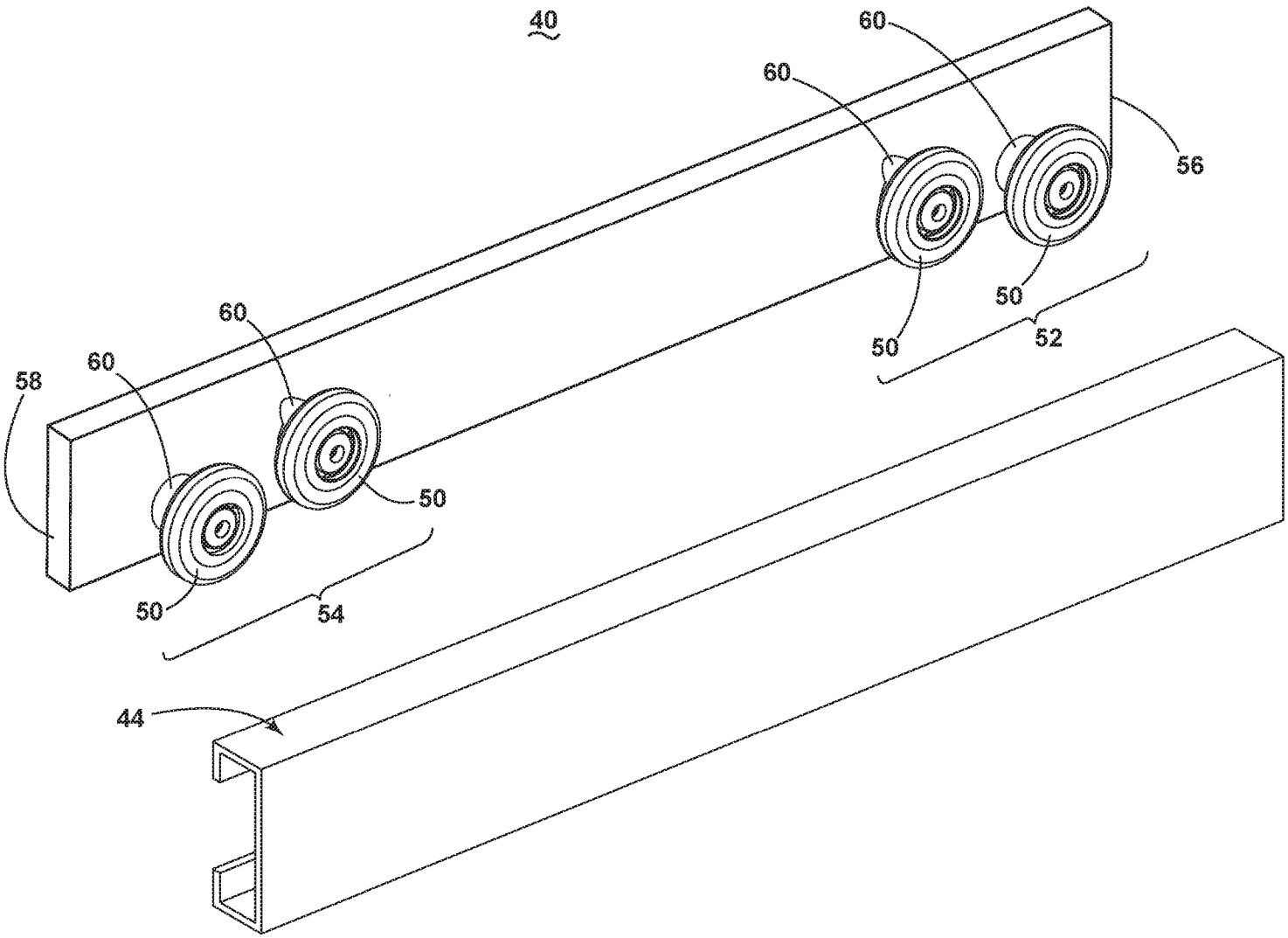
FIG. 2 is a side view of the guide rail assembly with four wheel assemblies.

FIG. 2 illustrates a perspective view of the guide rail assembly 40 according to an aspect of the disclosure described herein. The guide rail assembly 40 slidably mounts dishracks 15, 17 to the side walls 20 of the tub 14 so that the dishracks 15, 17 can slide in and out of the access opening 26 of the treating chamber 24. The guide rail assembly 40 includes a guide rail mount 42 and a guide rail track 44 and at least one wheel 50. One of the guide rail mount 42 or guide rail track 44 can include the at least one wheel 50. In the exemplary illustration, the guide rail mount 42 includes two pairs of wheels 52, 54 wherein the first pair of wheels 52 is located proximate a first end 56 of the guide rail mount 42 and the second pair of wheels 54 is located proximate a second end 58 of the guide rail mount 42, opposite the first end 56. While two pairs of wheels 52, 54 are shown, one wheel 50, or more than two pairs of wheels 52, 54 can be used and the configuration illustrated herein is not meant to be limiting.

At least one integral axle 60 extends from the guide rail mount 42. The at least one wheel 50 is rotatably mounted to the at least one integral axle 60. In one non-limiting example, four integral axles 60 extend from the guide rail mount 42. All four integral axles 60 are formed with the guide rail mount 42 during manufacturing such that the at least one integral axle 60 and all other portions of the guide rail mount 42 are one monolithic structure.

As used in this description, the term "integral" means that one or more items are mounted together or formed as a single piece with it being intended that the items are not separable during normal use and operation. Further, as used in this description, the term "monolithic" is a subset of "integral" and refers to when the one or more items are formed as a single piece, for example, the axles 60 and mount 42 are monolithic when they are injection molded as a single piece. In contrast, the axles 60 and mount 42 are "integral" when they are bonded to each other.

Figure 3:
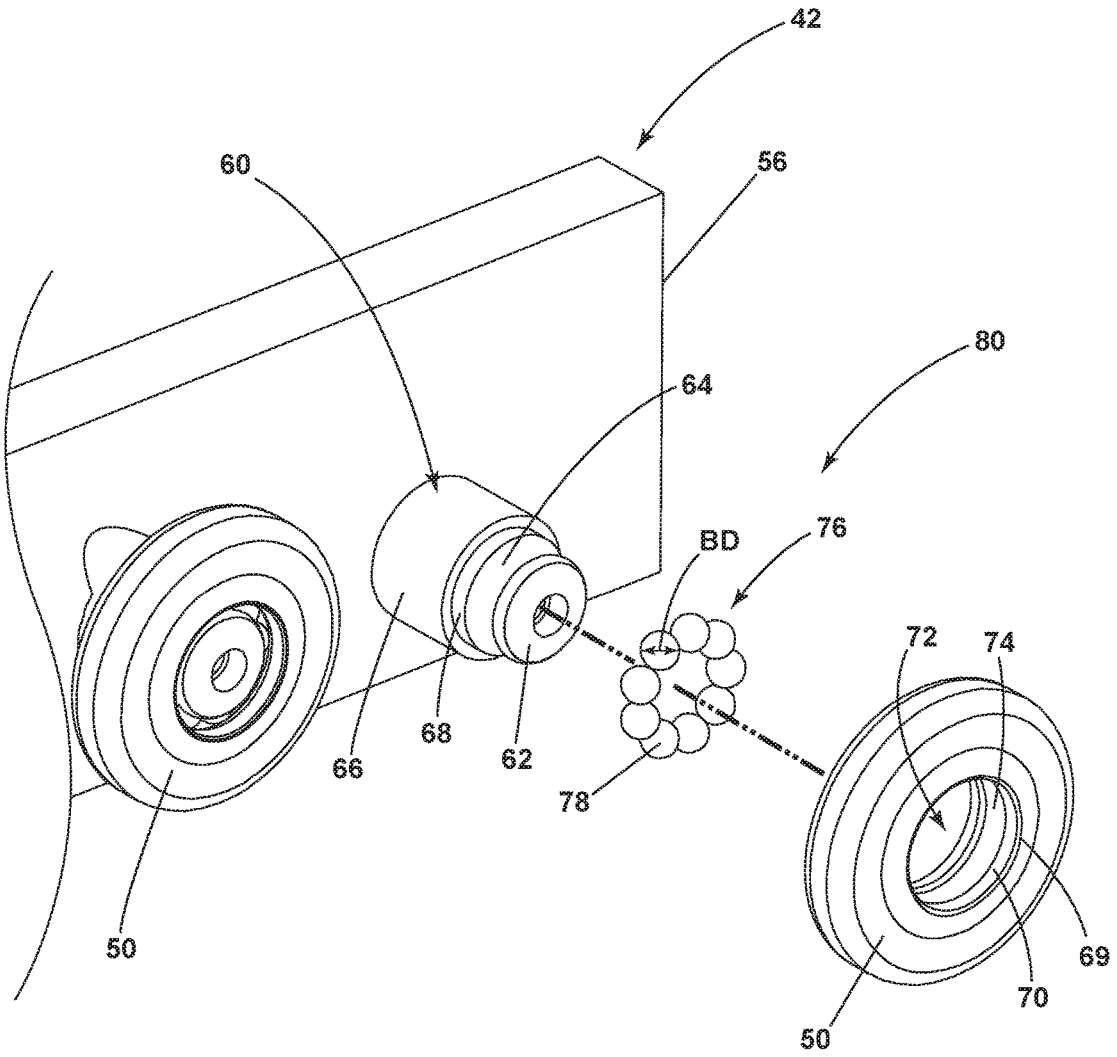
FIG. 3 is a partially exploded view of the wheel assembly.

FIG. 3 is a partially exploded view at the first end 56 of the guide rail mount 42. The integral axle 60 includes a base 66 and a hub 68. The base 66 extends from the guide rail mount 42 and the hub 68 extends from the base 66. The hub 68 terminates in a deflector 62. A first raceway 64 is located in the hub 68 between the deflector 62 and the base 66.

The at least one wheel 50 includes a rim 69 with a face 70 defining an axle opening 72. A second raceway 74 is located in the face 70. A set of ball bearings 76 fits in the second raceway 74. Each ball 78 has a ball diameter BD. Together the at least one wheel 50, the set of ball bearings 76, and the at least one integral axle 60 comprise a wheel assembly 80.

Figure 4:
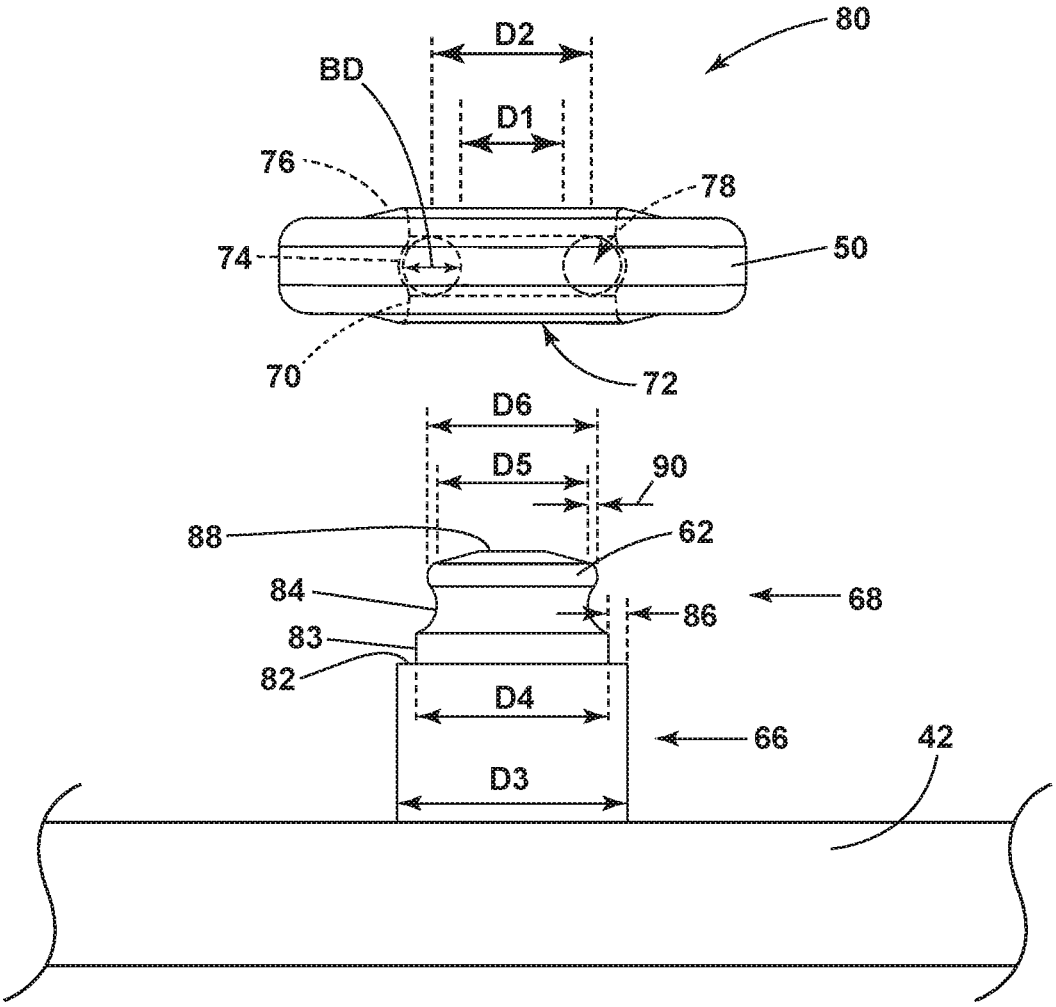
FIG. 4 is a top view of the wheel assembly.

Turning to FIG. 4, a top view of the wheel assembly 80 is illustrated. Two of the balls 78 from the set of ball bearings 76 are shown in phantom located within the second raceway 74 of the wheel 50. The axle opening 72 has a diameter D1. The set of ball bearings 76 define a second diameter D2 smaller than the first diameter D1.

The base 66 of the integral axle 60 has a substantially cylindrical form defining a base diameter D3. The hub 68 is located on the base 66 and defines a hub diameter D4. A lip 82 is formed where the base 66 meets the hub 68 and has a width 86 equal to the difference between the base diameter D3 and the hub diameter D4. The hub 68 extends from the base 66 in a substantially cylindrical hub base 83 maintaining the hub diameter D4. The first raceway 64 comprises a scalloped portion 84 in the hub 68 having a raceway diameter D5 that is less than the hub diameter D4. The deflector 62 comprises a distal end 88 of the hub 68 and defines a deflector diameter D6 at the widest portion of the deflector 62. The difference between the raceway diameter D5 and the deflector diameter D6 defines a depth 90 of the scalloped portion 84. The depth 90 is a distance ⅙ to ½ the ball diameter BD of each ball 78.

With relationship to each other, D3 is greater than D2 which is greater than D4 which is greater than D6 which is greater than D1 which is greater than or equal to D5. The relationship of the diameters D1, D2, D5, and D6 to each other enable a snap-fit of the wheel 50 to the integral axle 60 in one step. The lip 82 prevents the wheel 50 from rocking or rotating toward the guide rail mount 42 during sliding motion.

Figure 5:
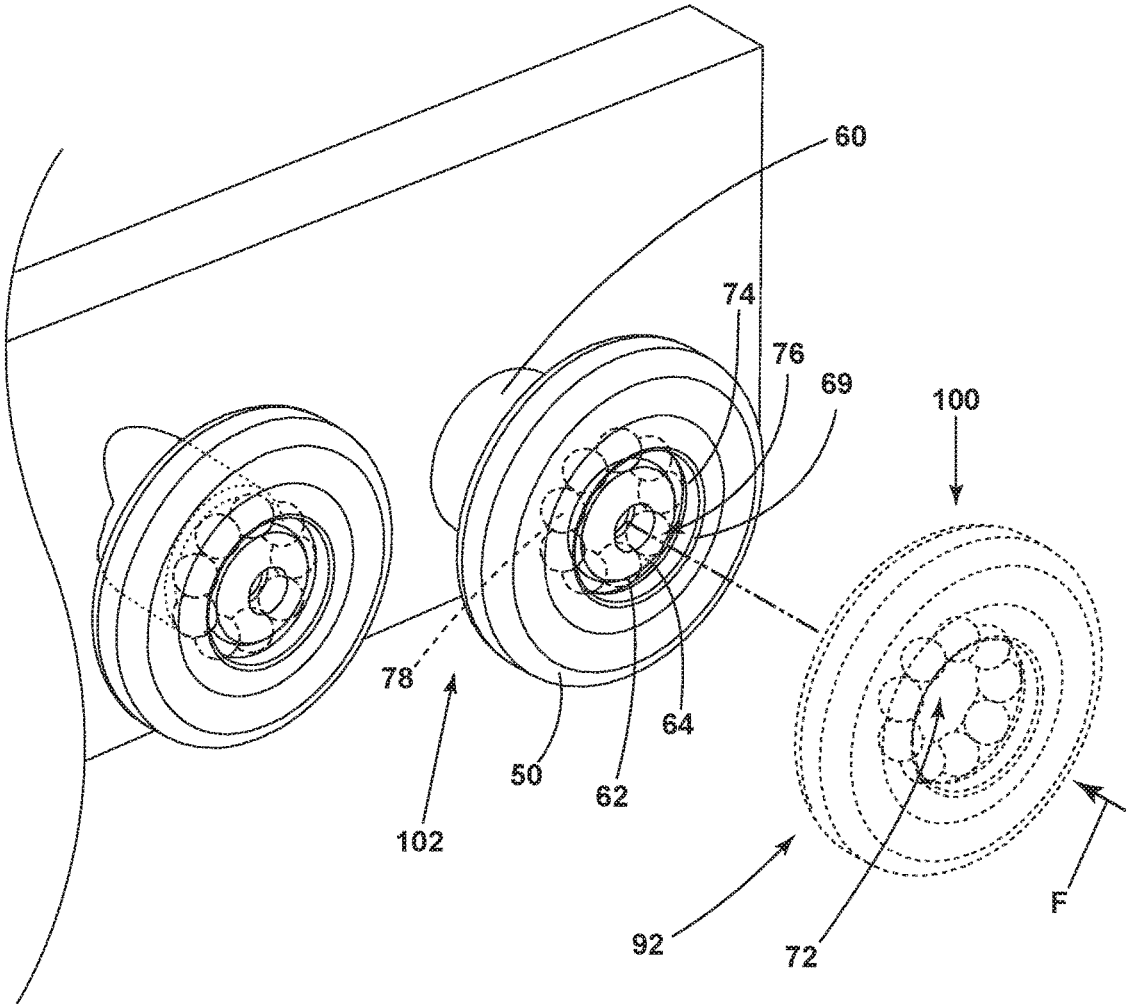
FIG. 5 is a perspective view of the wheel assembly in a first and second position.

Turning to FIG. 5, the wheel 50 and the set of ball bearings 76 form a single unit 92 that during the one step of assembly is forced onto the integral axle 60 as illustrated at a first location 100 in phantom to a final location 102 on the integral axle 60. The force F required to slide the wheel 50 onto the integral axle 60 until the first and second raceways 64, 74 are aligned is less than 1 N. Once assembled, the ball bearings 76 shown in phantom in the final location 102 are free to move along the first and second raceways 64, 74.

Figure 6:
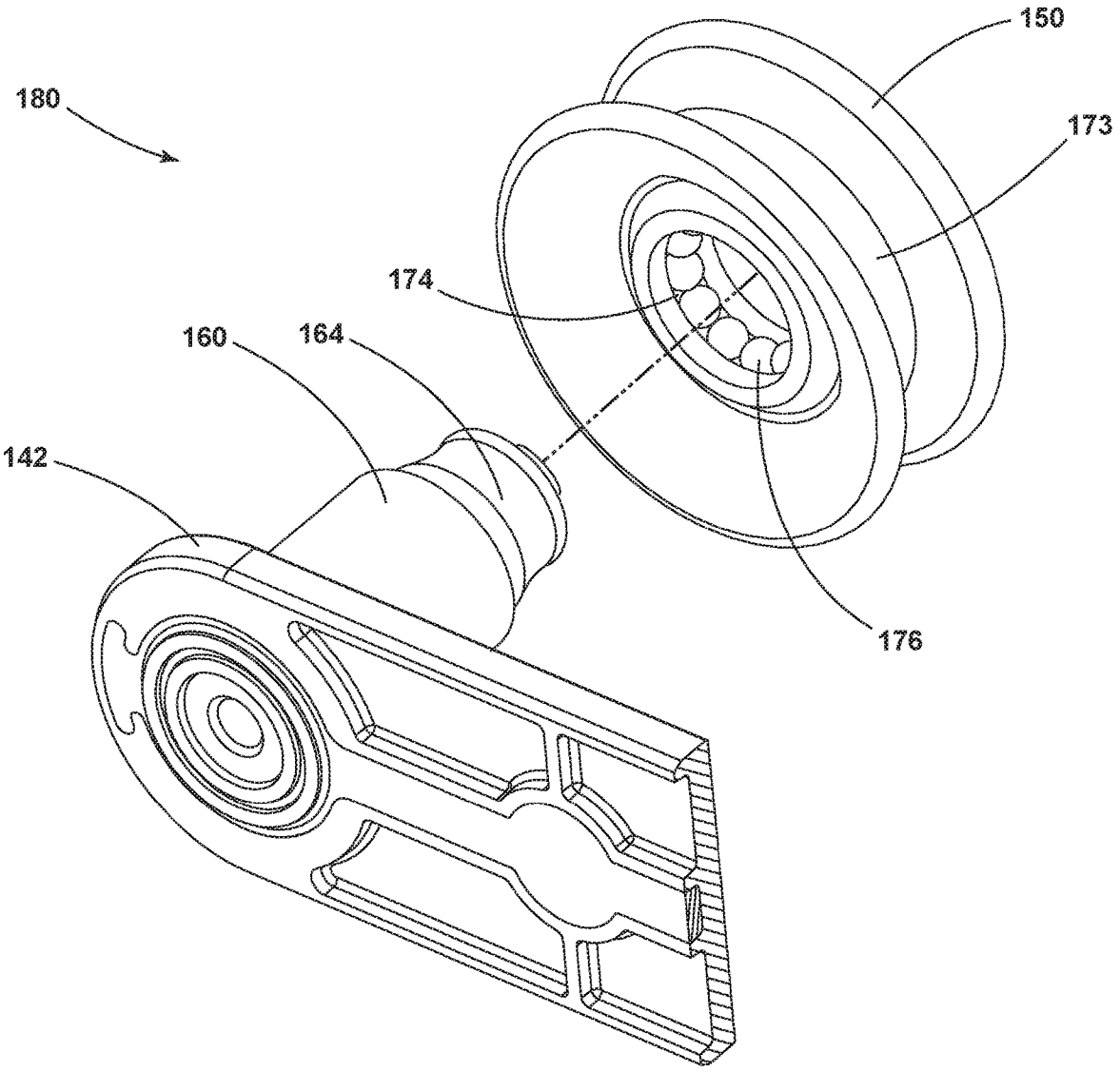
FIG. 6 is a perspective view of a wheel assembly according to a second embodiment of the guide rail assembly.
Figure 7:
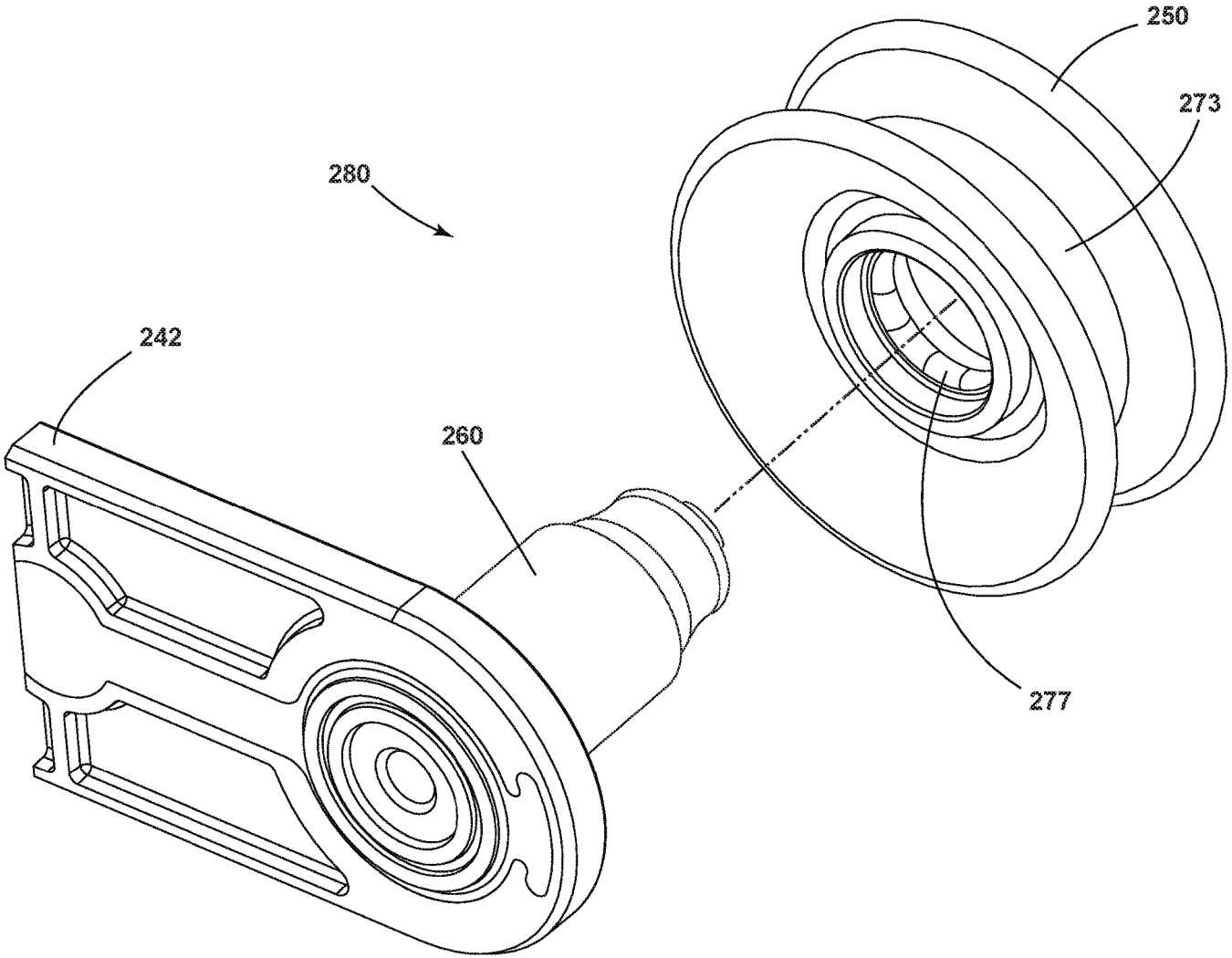
FIG. 7 is a perspective view of a wheel assembly according to a third embodiment of the guide rail assembly.

FIG. 6 and FIG. 7 illustrate other exemplary wheel assemblies 180, 280 for guide rail assemblies 40 according to a second and third embodiment of the disclosure. The embodiments are similar to the first embodiment; therefore, like parts will be identified with like numerals increased by 100 and 200 respectively with it being understood that the description of the like parts of the first embodiment applies to the following embodiments, unless otherwise noted.

In FIG. 6, a guide rail mount 142, for mounting to, in one non-limiting example, a sidewall of a tub for a dishwasher, includes an integral axle 160 having dimensions like the integral axle 60 described herein, and a first raceway 164. A wheel 150 including an outer raceway 173 formed to receive a guide rail (not shown) includes a set of ball bearings 176. The set of ball bearings 176 sit in a second raceway 174 within the wheel 150.

FIG. 7 illustrates a third embodiment of a wheel assembly 280 similar in geometry and dimension the wheel assembly 180. A bearing surface 277 is formed in a wheel 250 where the set of ball bearings 76 of the original wheel assembly 80 are placed in the wheel 50. In the third embodiment, the bearing surface 277 is formed from a low friction material that can include but is not limited to a filled or unfilled Polyoxymethylene or polypropylene, in order to produce rolling similar to the ball bearings 76, 176 of the first two embodiments.

The embodiments described herein can be used to slidably mount a dishrack in a dishwasher, ensuring that the wheels of the guide rail assembly roll freely without opposing forces. These embodiments can be used to avoid the undesirable circumstances when wheels bind up due to opposing forces.

The guide rail assemblies described herein decrease the amount of parts necessary for assembly. This is both a cost-effective and time savings benefit over traditional guide rail assemblies. Decreasing the number of parts also decreases the likelihood of replacing and fixing missing or broken parts. Additionally, forming the integral axle with the guide rail as one part and then forming the first raceway in the integral axle decreases the likelihood of binding and bumpy transitions while sliding the dishrack in and out of the dishwasher.

To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A dishwasher comprising:

a tub at least partially defining a treating chamber having an access opening;

a dishrack;

a guide rail assembly slidably mounting the dishrack to the tub and comprising:

a guide rail, mounted to one of the dishrack and tub, having at least one integral axle with a first raceway and terminating in a deflector, the guide rail and at least one integral axle forming one monolithic structure, at least one wheel having a rim with a face defining an axle opening and a second raceway located in the face, and a set of ball bearings located in the second raceway, wherein the axle opening is sized to receive the axle such that the at least one wheel can be slid onto the axle until the first and second raceways axially align and the ball bearings in the second raceway are deflected by the deflector into the second raceway until the first and second raceways are aligned and the ball bearings extend into both the first and second race ways.

2. The dishwasher of claim 1 wherein the ball bearings each have a ball diameter.

3. The dishwasher of claim 2 wherein the deflector defines a depth spaced from the first raceway a distance equal to ⅙ to ½ the ball diameter.

4. The dishwasher of claim 1 wherein a force required to push the at least one wheel with the set of ball bearings onto the axle is less than 1 N.

5. The dishwasher of claim 1 wherein the ball bearings are integral with the second raceway to define a bearing surface.

6. The dishwasher of claim 1 wherein the axle opening defines a first diameter, the ball bearings define a second diameter, the integral axle comprises a base having a cylindrical form defining a third diameter, the integral axle comprises a hub defining a fourth diameter, the hub includes the second raceway comprising a scalloped portion defining a fifth diameter, and the deflector defines a sixth diameter.

7. The dishwasher of claim 6 wherein the second diameter is greater than the sixth diameter and the sixth diameter is greater than the first diameter and the first diameter is greater than or equal to the fifth diameter.

8. The dishwasher of claim 6 wherein the third diameter is greater than the second diameter and the second diameter is greater than the fourth diameter and the fourth diameter is greater than the sixth diameter and the sixth diameter is greater than the first diameter and the first diameter is greater than or equal to the fifth diameter.

9. The dishwasher of claim 1 wherein the at least one wheel is rotatably mounted to the dishrack.

10. The dishwasher of claim 9 wherein the guide rail is mounted to the tub.

11. The dishwasher of claim 10 wherein the guide rail is slidably mounted to the tub.

12. A guide rail assembly comprising:

a guide rail mounted to one of a dishrack and a tub and having, at least one integral axle extending from the guide rail to form a unitary monolithic structure, the at least one integral axle having a first raceway and terminating in a deflector, at least one wheel having a face defining an axle opening and a second raceway located in the face, and a set of ball bearings located in the second raceway, wherein the axle opening is sized to receive the axle such that the at least one wheel can be slid onto the axle until the first and second raceways axially align and the ball bearings in the second raceway are deflected by the deflector into the second raceway until the first and second raceways are aligned and the ball bearings extend into both the first and second race ways.

13. The guide rail assembly of claim 12 wherein the ball bearings each have a ball diameter.

14. The guide rail assembly of claim 13 wherein the deflector defines a depth spaced from the first raceway a distance equal to ⅙ to ½ the ball diameter.

15. The guide rail assembly of claim 12 wherein a force required to push the at least one wheel with the set of ball bearings onto the axle is less than 1 N.

16. The guide rail assembly of claim 12 wherein the ball bearings are integral with the second raceway to define a bearing surface.

17. The guide rail assembly of claim 12 wherein the axle opening defines a first diameter, the ball bearings define a second diameter, the integral axle comprises a base having a cylindrical form defining a third diameter, the integral axle comprises a hub defining a fourth diameter, the hub includes the second raceway comprising a scalloped portion defining a fifth diameter, and the deflector defines a sixth diameter.

18. The guide rail assembly of claim 17 wherein the second diameter is greater than the sixth diameter and the sixth diameter is greater than the first diameter and the first diameter is greater than or equal to the fifth diameter.

19. The guide rail assembly of claim 17 wherein the third diameter is greater than the second diameter and the second diameter is greater than the fourth diameter and the fourth diameter is greater than the sixth diameter and the sixth diameter is greater than the first diameter and the first diameter is greater than or equal to the fifth diameter.

20. The guide rail assembly of claim 12 wherein the at least one wheel is rotatably mounted to the dishrack.

21. The guide rail assembly of claim 20 wherein the guide rail is mounted to the tub.

22. The guide rail assembly of claim 21 wherein the guide rail is slidably mounted to the tub.

23. A dishwasher comprising:

a tub at least partially defining a treating chamber having an access opening;

a dishrack;

a guide rail assembly slidably mounting the dishrack to the tub and comprising:

a single piece defining a monolithic structure comprising a guide rail and at least one integral axle with a first raceway, the monolithic structure mounted to one of the dishrack and tub, at least one wheel having a face defining an axle opening and a second raceway located in the face, and a set of ball bearings located in the second raceway, wherein the axle opening is sized to receive the axle such that the at least one wheel can be slid onto the axle until the first and second raceways axially align and the ball bearings extend into both the first and second race ways.

24. The dishwasher of claim 23 wherein the at least one integral axle terminates in a deflector.

25. The dishwasher of claim 24 wherein the ball bearings each have a ball diameter.

26. The dishwasher of claim 25 wherein the deflector defines a depth spaced from the first raceway a distance equal to ⅙ to ½ the ball diameter.

27. The dishwasher of claim 24 wherein the axle opening defines a first diameter, the ball bearings define a second diameter, the integral axle comprises a base having a cylindrical form defining a third diameter, the integral axle comprises a hub defining a fourth diameter, the hub includes the second raceway comprising a scalloped portion defining a fifth diameter, and the deflector defines a sixth diameter.

28. The dishwasher of claim 27 wherein the second diameter is greater than the sixth diameter and the sixth diameter is greater than the first diameter and the first diameter is greater than or equal to the fifth diameter.

29. The dishwasher of claim 27 wherein the third diameter is greater than the second diameter and the second diameter is greater than the fourth diameter and the fourth diameter is greater than the sixth diameter and the sixth diameter is greater than the first diameter and the first diameter is greater than or equal to the fifth diameter.

30. The dishwasher of claim 1 wherein a force required to push the at least one wheel with the set of ball bearings onto the axle is less than 1 N.

31. The dishwasher of claim 1 wherein the ball bearings are integral with the second raceway to define a bearing surface.

32. The dishwasher of claim 23 wherein the at least one wheel is rotatably mounted to the dishrack.

33. The dishwasher of claim 32 wherein the guide rail is mounted to the tub.

34. The dishwasher of claim 33 wherein the guide rail is slidably mounted to the tub.

* * * * *